US006293759B1

(12) United States Patent
Thut

(10) Patent No.: US 6,293,759 B1
(45) Date of Patent: Sep. 25, 2001

(54) DIE CASTING PUMP

(76) Inventor: Bruno H. Thut, 16755 Park Circle Dr., Chagrin Falls, OH (US) 44023-4598

( * ) Notice: Subject to any disclaimer, the term of this patent is extended or adjusted under 35 U.S.C. 154(b) by 0 days.

(21) Appl. No.: 09/430,796

(22) Filed: Oct. 31, 1999

(51) Int. Cl.[7] ..... F04B 19/24; B22D 17/04
(52) U.S. Cl. ..... 417/53; 164/312
(58) Field of Search ..... 417/53, 306, 415; 164/312, 313, 113

(56) References Cited

U.S. PATENT DOCUMENTS

| | | | | |
|---|---|---|---|---|
| 274,104 | | 3/1883 | Ayers | 417/118 |
| 350,761 | | 10/1886 | Neff | 417/118 |
| 1,689,698 | | 10/1928 | Tornberg | 164/150.1 |
| 1,736,188 | | 11/1929 | Daeson et al. | 417/118 |
| 1,954,775 | | 4/1934 | During et al. | 164/257 |
| 2,195,360 | | 3/1940 | Daeson | 164/113 |
| 2,372,603 | | 3/1945 | Pilkington | 266/239 |
| 2,390,263 | | 12/1945 | Mills | 164/316 |
| 2,837,792 | | 6/1958 | Ring | 164/258 |
| 3,015,849 | | 1/1962 | Mittlestadt et al. | 164/314 |
| 3,209,418 | | 10/1965 | Smith | 164/318 |
| 3,319,702 | | 5/1967 | Hartwig et al. | 164/316 |
| 3,467,171 | | 9/1969 | Fulgenzi et al. | 164/316 |
| 3,515,203 | | 6/1970 | Parlanti et al. | 164/312 |
| 3,533,464 | | 10/1970 | Parlanti et al. | 164/312 |
| 3,586,095 | | 6/1971 | Fulgenzi | 164/312 |
| 3,672,440 | | 6/1972 | Miura et al. | 164/312 |
| 3,701,378 | * | 10/1972 | Graham | 164/113 |
| 4,248,289 | * | 2/1981 | Perella et al. | 164/153 |
| 4,252,176 | * | 2/1981 | Page | 164/155 |
| 4,991,641 | * | 2/1991 | Kidd et al. | 164/120 |
| 5,012,856 | | 5/1991 | Zecman | 164/312 |
| 5,375,646 | | 12/1994 | Stummer et al. | 164/457 |
| 5,388,633 | | 2/1995 | Mercer, II et al. | 164/457 |
| 5,394,931 | | 3/1995 | Shiina et al. | 164/113 |
| 5,454,423 | * | 10/1995 | Tsuchida et al. | 164/337 |
| 5,630,464 | | 5/1997 | Bauman et al. | 417/118 |

* cited by examiner

*Primary Examiner*—Charles G. Freay
*Assistant Examiner*—Michael K. Gray
(74) *Attorney, Agent, or Firm*—Watts Hoffmann Fisher & Heinke

(57) ABSTRACT

An apparatus for pumping molten metal includes a pump base comprised of non-metallic, heat resistant material and adapted to be submerged in a bath of molten metal. The pump base includes a molten metal inlet opening; a molten metal valve chamber in communication with the inlet opening; a molten metal pumping chamber; a passageway that communicates the valve chamber and the pumping chamber and a molten metal outlet opening that communicates with the pumping chamber. A first piston made of non-metallic, heat resistant material is adapted for reciprocal movement in the valve chamber. A second piston made of non-metallic, heat resistant material is adapted for reciprocal movement in the pumping chamber. A first connecting member extends upwardly from the first piston and a second connecting member extends upwardly from the second piston. At least one actuator is in communication with the first and second connecting members. The at least one actuator acts upon the first and second connecting members to effect the reciprocal movement of the first and second pistons. When used in a die casting apparatus, also featured is a shot chamber disposed near the discharge opening for receiving molten metal discharged from the conduit. A ram is disposed in the chamber for injecting the molten metal in the chamber into a die for casting the molten metal.

24 Claims, 4 Drawing Sheets

DIE CASTING PUMP

FIELD OF THE INVENTION

The present invention is directed to the field of pumps for pumping molten metal and, in particular, to using a pump for pumping molten metal into a shot sleeve for die casting metal parts. More specifically, the invention is directed to an apparatus for die casting high melting point alloys containing aluminum or magnesium, and the like.

BACKGROUND OF THE INVENTION

Metal parts may be produced using "cold chamber" and "hot chamber" die casting apparatuses. Cold chamber apparatuses employ a molten metal reservoir that is separated from the casting machine. Enough metal for one just casting is normally ladled by hand through a port of a small chamber referred to as a shot sleeve. Since this is done by hand it undesirably results in variation in the quantity of molten metal that is fed into the shot sleeve. A hydraulically actuated ram moves in the shot sleeve to force the molten metal under pressure into a die. As the ram advances, it seals the port and forces the charge into the die at pressures which may range from several psi to 60,000 psi or more. The molten metal cools in the chamber prior to injection into the die, thereby lending itself to description as a "cold chamber" process.

The hot chamber process is used for low melting point alloys such as zinc alloys and, may employ, for example, a machine comprising a fixed cylinder having a spout firmly connected to a nozzle locked against a die cavity. A piston operating in the cylinder is raised to uncover an inlet port below the molten metal level in the pot. After the molten metal fills the interior of the cylinder, the piston is forced downward, which causes the molten metal to flow through the spout and into the die. Once the metal solidifies in the die the piston is withdrawn, the die is opened and the casting is removed. The die is then closed and the process repeated.

It is generally believed that better metallurgical castings result from use of the hot chamber process since the molten metal is not cooled as in the cold chamber process. However, numerous attempts have been made to develop a hot chamber apparatus for casting high melting point aluminum without widespread success. In view of difficulties presented in the hot chamber process, the industry could benefit from a cold chamber die casting apparatus which eliminates the risk of workers having to carry out the dangerous task of ladling molten metal, and from a process which produces an accurate charge of molten metal into the shot sleeve.

SUMMARY OF THE INVENTION

An apparatus for pumping molten metal includes a pump base comprised of non-metallic, heat resistant material and adapted to be submerged in a bath of molten metal. The pump base includes a molten metal inlet opening; a molten metal valve chamber in communication with the inlet opening; a molten metal pumping chamber; a passageway that communicates the valve chamber and the pumping chamber and a molten metal outlet opening that communicates with the pumping chamber. A first piston made of non-metallic, heat resistant material is adapted for reciprocal movement in the valve chamber. A second piston made of non-metallic, heat resistant material is adapted for reciprocal movement in the pumping chamber. A first connecting member extends upwardly from the first piston and a second connecting member extends upwardly from the second piston. At least one actuator is in communication with the first and second connecting members. The at least one actuator acts upon the first and second connecting members to effect the reciprocal movement of the first and second pistons. When used in a die casting apparatus, preferably of the cold chamber type, also featured is a shot chamber disposed near the discharge opening for receiving molten metal discharged from the conduit. A ram is disposed in the chamber and adapted to direct molten metal in the chamber to a die for casting the molten metal.

In particular, support structure is connected to the base outside the bath. At least one removable stop member is disposed between the support structure and the second piston, the at least one stop member being configured and arranged so as to restrict movement of the second piston by a distance corresponding to at least one of a size and location of the stop member. At least one annular gasket comprised of refractory material is disposed around the second piston. The apparatus may also include an annular sealing member disposed around the second piston. The sealing member includes radial outlet openings therethrough. A drain opening is located near the outlet openings and extends to an exterior of the base.

The present invention advantageously enables an accurate charge of molten metal to be transferred to the shot chamber, which improves the die casting process. In addition, the risk associated with ladling the molten metal by hand, is avoided. The charge may be accurately varied as well, using stop member sleeves, a vertically movable stop plate and the like. The valve of the pump is advantageous in that it is a reliable and efficient way to facilitate the charge into the pumping chamber.

The present invention is especially adapted for use in the cold chamber process, to replace the hand ladling that is often used. However, the present apparatus may be used in a hot chamber die casting process, by connecting the conduit with the shot sleeve or directly to a die without using a shot sleeve. A seal would be disposed around the plunger that is suitable to enable sufficient pressure to be generated in the pumping chamber. In addition, the conduit may be heated or suitably insulated so as to prevent chilling of the molten metal prior to entering the die.

A method of pumping molten metal using the pump base includes a molten metal feed stage comprising positioning the first piston at a location that enables molten metal to enter the valve chamber through the inlet opening, and positioning the second piston in the pumping chamber so as to permit molten metal to enter the pumping chamber. A molten metal pumping stage includes positioning the first piston so as to prevent molten metal from entering the valve chamber, and moving the second piston so as to discharge molten metal from the pumping chamber and to direct molten metal from the outlet opening through a conduit into the shot chamber. The molten metal is then injected from the shot chamber into a cavity of a die.

In cold chamber die casting the molten metal that is received in the shot chamber is exposed to external air while passing from the conduit to the shot chamber. In the case of hot chamber die casting, molten metal is passed from the conduit to the shot chamber without exposing the molten metal to external air or from the conduit directly to the die.

Molten metal may be sealed in the pumping chamber using the annular sealing member disposed around the second piston. Pressure is relieved by passing molten metal out through radial exit openings in the sealing member and through the drain hole to the exterior of the base.

In particular, one embodiment of the invention is directed to a method of die casting molten metal comprising moving a piston in a pumping chamber within a bath of molten metal to inject the molten metal into a die and then casting the molten metal. The pumping chamber is sealed using an annular sealing member disposed around the piston, and relieving pressure by passing molten metal outwardly through radial exit openings in the sealing member and through a drain hole to an exterior of the base. The pumping chamber may be further sealed using at least one annular gasket formed of refractory material around the piston. The at least one gasket and sealing member may be compressed to improve the sealing effect.

Many additional features, advantages, and a fuller understanding of the invention will be had from the accompanying drawings and the detailed description that follows.

DETAILED DESCRIPTION OF PREFERRED EMBODIMENTS

Figure 1:
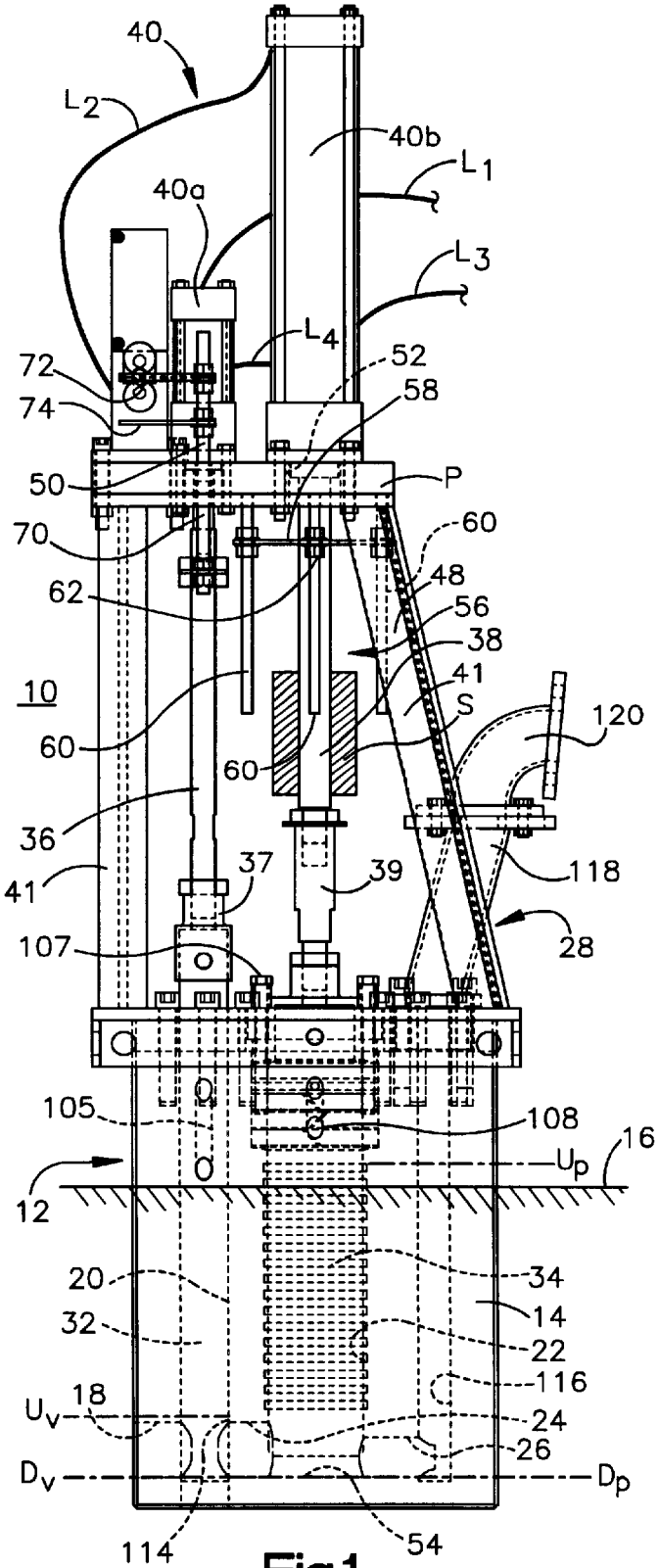
FIG. 1 is a front view of a pumping apparatus of the present invention.

Referring now to the drawings and to FIGS. 1–3 and 5 in particular, there is shown an apparatus 10 for die casting molten metal such as aluminum, the apparatus being preferably of the "cold chamber" type, comprising a pump 12 including a pump base 14 disposed in a pot or bath of molten metal 16. The pump base is preferably a unitary block, comprised of non-metallic, heat resistant material and is adapted to be submerged in the bath. There is a molten metal inlet opening 18 in the pump base. In communication with the inlet opening is a molten metal valve chamber 20. A molten metal pumping chamber 22 communicates, via a passageway 24, with the valve chamber as well as with a molten metal outlet opening 26. A conduit 28 extends from the outlet opening 26 to an outlet opening near a discharge location 30 outside the bath. A first piston or valve 32 made of non-metallic, heat resistant material is adapted for reciprocal movement in the valve chamber 20 and a second piston or plunger 34 made of non-metallic, heat resistant material is adapted for reciprocal movement in the pumping chamber 22. A first connecting member 36 extends upwardly from and is coupled to the valve at 37 and a second connecting member 38 extends upwardly from and is coupled to the plunger at 39. At least one actuator 40 moves the first and second connecting members so as to effect the reciprocal movement of the valve and plunger. A shot sleeve 42 is disposed near the discharge opening for receiving molten metal discharged from the conduit. A ram 44 disposed in chamber 45 of the shot sleeve is adapted to direct molten metal in the chamber into an opening of a die 46 for casting the molten metal into suitable parts.

The actuator 40 is preferably a hydraulic cylinder, a compressed air type cylinder being preferred. It is preferred to employ two such cylinders, one (40*a*) for actuating the valve and the other (40*b*) for actuating the plunger. The hydraulic cylinders are supported on a support structure 48 attached to the pump base disposed outside the bath. The support structure includes legs 41 extending from the base which support an upper platform P.

The first connecting member 36 is coupled at its upper end with an actuating rod of one of the air cylinders, the general location of which is indicated at 50. The second connecting member 38 is coupled at its upper end with an actuating rod of the other of the air cylinders 40*b*, the general location of which is indicated at 52. The first and second connecting rods may be formed of metal. The valve and plunger are formed of suitable non-metallic refractory material such as graphite, ceramic or the like, preferably silicon carbide. A suitable shape of the valve chamber, pumping chamber, valve and plunger, is cylindrical.

The present invention advantageously permits a metered or predetermined amount of molten metal to be delivered into the shot sleeve. This is accomplished by varying the size of a cavity 54 in the pumping chamber by positioning the plunger at a particular generally vertical location. The size of this cavity is reduced by moving the plunger toward the bottom of the pumping chamber $D_P$ and increased by moving the plunger toward an upper location of the pumping chamber $U_P$.

A removable stop member is used to restrict upward movement of the plunger by a distance corresponding to a size and/or location of the stop member. One suitable stop member assembly 56 comprises exteriorly threaded support rods 60, four symmetrical rods being preferred, which are mounted so as to extend downwardly from the upper platform. Suitable fasteners 62 are used to fasten a stop plate 58 at a particular vertical location along the threaded rods. The stop plate includes a central opening (not shown) that is sized large enough to enable the connecting member 38 to be moved within it, but small enough to prevent upward movement of the plunger. The opening in the stop plate is preferably sized to prevent passage of the coupling 39 therethrough.

When the size of the cavity 54 and corresponding volume of molten metal to be displaced by the plunger, is intended to be increased, the stop plate is moved up along the rods and fastened securely in position. Conversely, when it is desired to reduce the size of the cavity and corresponding volume of molten to be displaced by the plunger, the stop plate is moved down along the rods and fastened securely in position.

Alternatively, another stop member that may be used is an annular member S that restricts either upward or downward movement of the plunger. The stop member S may be a metal split ring with spring closure or the like, which may be opened and securely fastened around the connecting member 38. The stop member S may be used instead of the stop member assembly 56 and would preferably abut against the platform P and the coupling 39. Various stop members S may be used, each of a different length. A longer stop member S in restricting upward movement of the plunger decreases the volume of the cavity 54, whereas a shorter such stop member S increases the volume of the cavity 54. The stop member S may be fastened at other locations, not shown, such as near the platform P or below the coupling 39 in restricting downward movement of the plunger.

The motion of the plunger may advantageously be timed or coordinated with the motion of the valve. That is, after the valve descends to the closed position, the plunger is caused to descend to the lower position $D_P$. Then, when the valve is moved upwardly to the open position, the plunger is moved upwardly against the stop plate to the starting position $U_P$, whereupon the process is repeated.

Actuation of the air cylinders and corresponding movement of the valve and plunger, may be accomplished by hand (whereupon an operator manually moves the handles of the hydraulic cylinders for the plunger and/or the valve), automatically using electronic timing mechanisms (e.g., using limit switches) or semiautomatically. Those skilled in the art would, in view of this disclosure, appreciate various ways to move the valve and piston independently or dependently, in accordance with the present invention.

Figure 12:
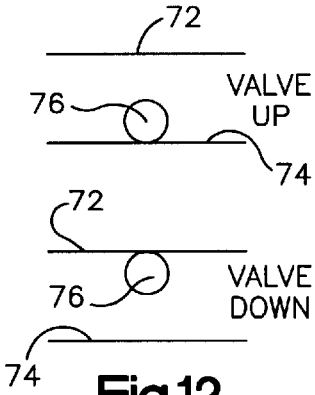
FIG. 12 is a view depicting positioning of an apparatus used for coordinating movement of pistons of the present invention.

One semiautomatic mechanism for moving the plunger in coordination with the valve is best shown in FIGS. 1–3 and 4. An arm 64 has an opening 66 that receives the second connecting member 38, and is fastened in place thereon. The arm extends outwardly from the connecting member and at another end has an opening 68 that receives a threaded rod 70 that extends downwardly from the upper platform. There is an opening in the upper platform (not shown) that permits vertical movement of the rod. Connected to an upper end of the rod are upper and lower kick plates 72, 74. Between these kick plates is disposed a detented ball handle 76 extending via a rod 77 from a pneumatic control mechanism 78. As shown in FIG. 12, the upward movement of the valve moves the rod 70 up, thereby causing the lower kick plate 74 to move the handle up, while the downward movement of the valve moves the rod 70 down, thereby causing the upper kick plate 72 to move the handle down. The upper and lower positions of the handle are generally shown in the figures for improving one's understanding, and are not intended to be consistent with the particular position of the valve and plunger that are shown in those figures.

Figure 6:
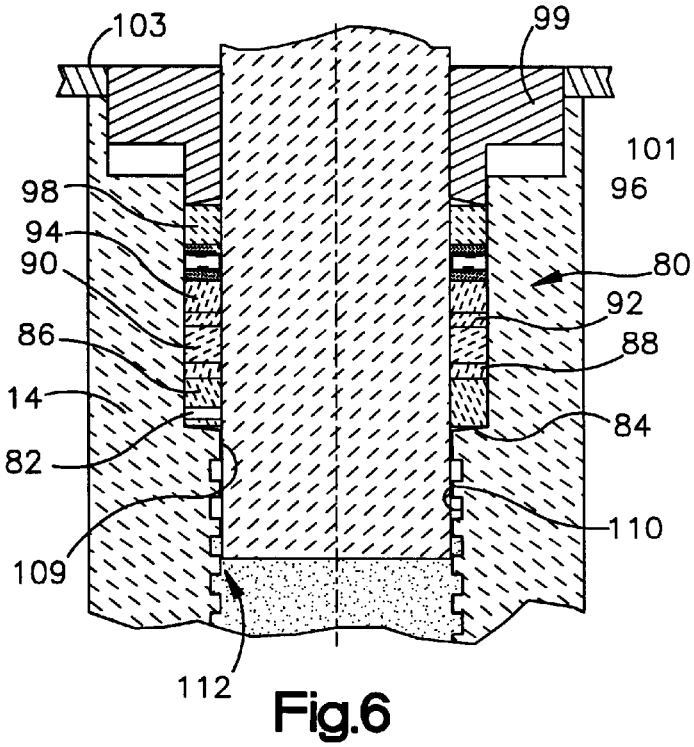
FIG. 6 is a cross-sectional view depicting a seal assembly of the present invention.
Figure 7:
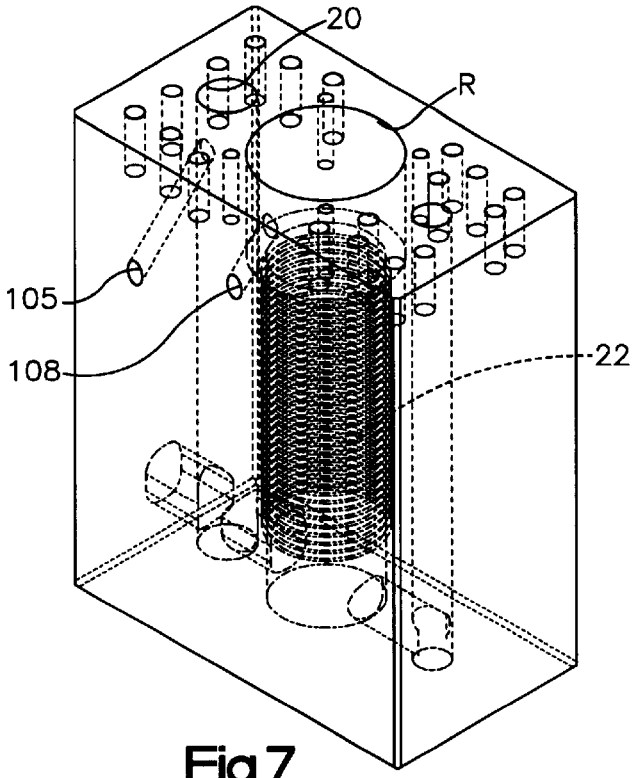
FIG. 7 is a perspective view of the base of the present invention.
Figure 8:
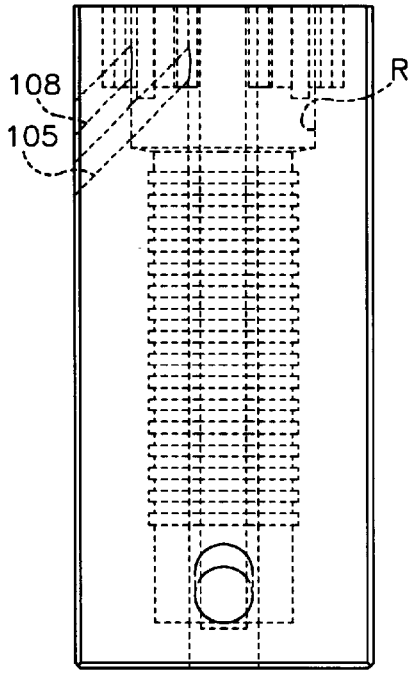
FIG. 8 is an end view of the base.
Figure 9:
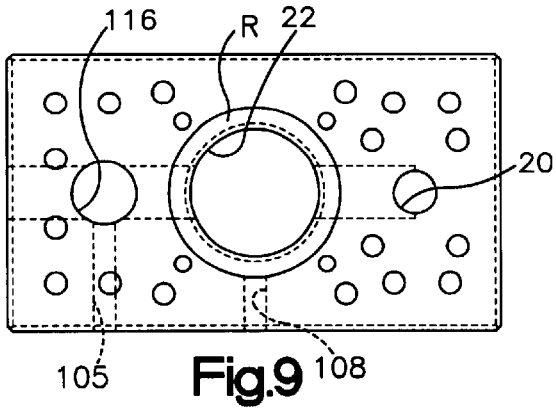
FIG. 9 is a top plan view of the base.

Referring to FIG. 6, a gasket assembly 80 is adapted to seal molten metal while the plunger moves in the pumping chamber. The gasket assembly permits pressure to be generated by the plunger in the pumping chamber sufficient to overcome the head of molten metal, and enables transfer of the molten metal from the base to the discharge location. The gasket assembly is also intended to avoid the safety hazard of molten metal spraying from the pump during use.

Figure 10:
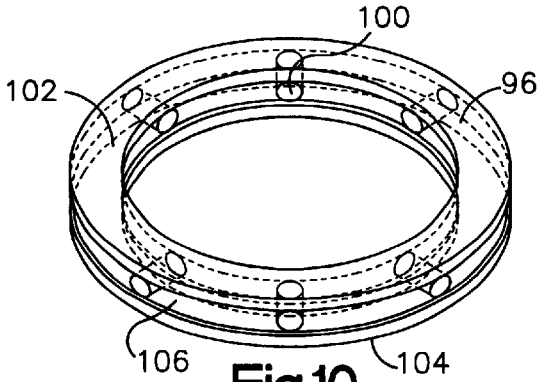
FIG. 10 is a sealing member of the present invention.

The gasket assembly 80 preferably comprises a combination of components. A first Fiberfrax™ brand gasket 82 is disposed at the bottom on a shoulder 84 in an outer annular region R around the pumping chamber. Above this gasket is disposed a first Fiberfrax™ brand square braid member 86, enclosed in wiremesh (stainless steel type 316 Inconel, or the like) coated with graphite. Next is disposed a second Fiberfrax™ brand gasket 88. Atop this is disposed a second Fiberfrax™ brand square braid member 90. Above this is a third Fiberfrax™ brand gasket 92. Next is a third Fiberfrax™ brand square braid member 94. Above this is a lantern member 96 shown in FIG. 10. Finally, above the lantern is disposed a fourth Fiberfrax™ brand square braid member 98. The Fiberfrax™ brand gaskets are preferably ⅛ inch thick and the Fiberfrax™ brand square braid members are preferably ½ inch thick.

Figure 2:
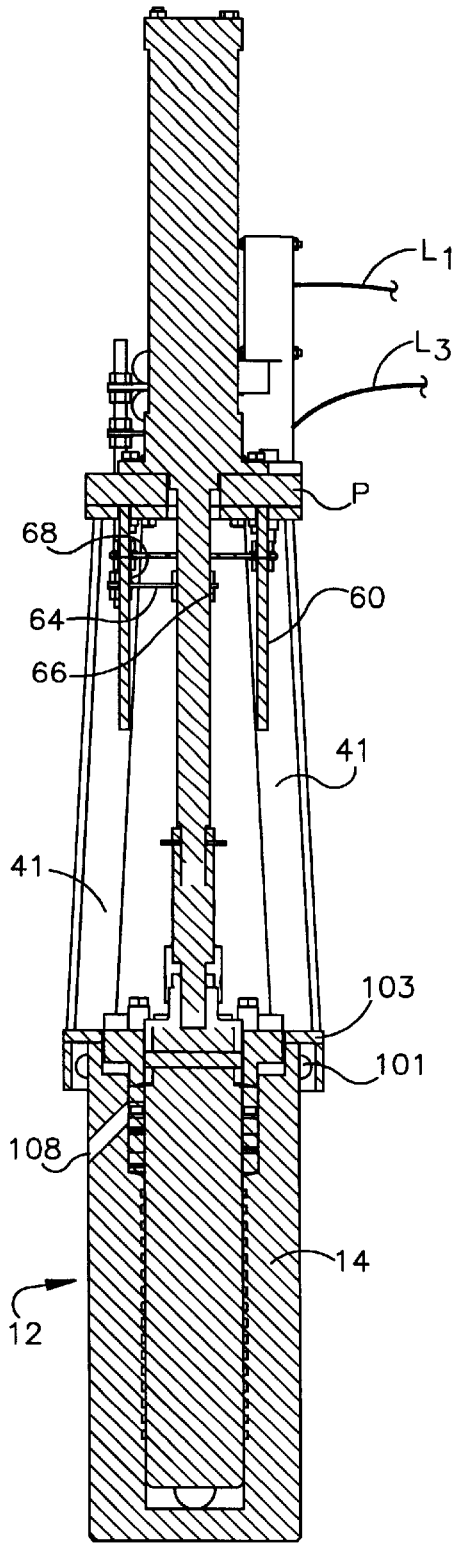
FIG. 2 is a vertical cross-sectional view of the apparatus of FIG. 1.
Figure 3:
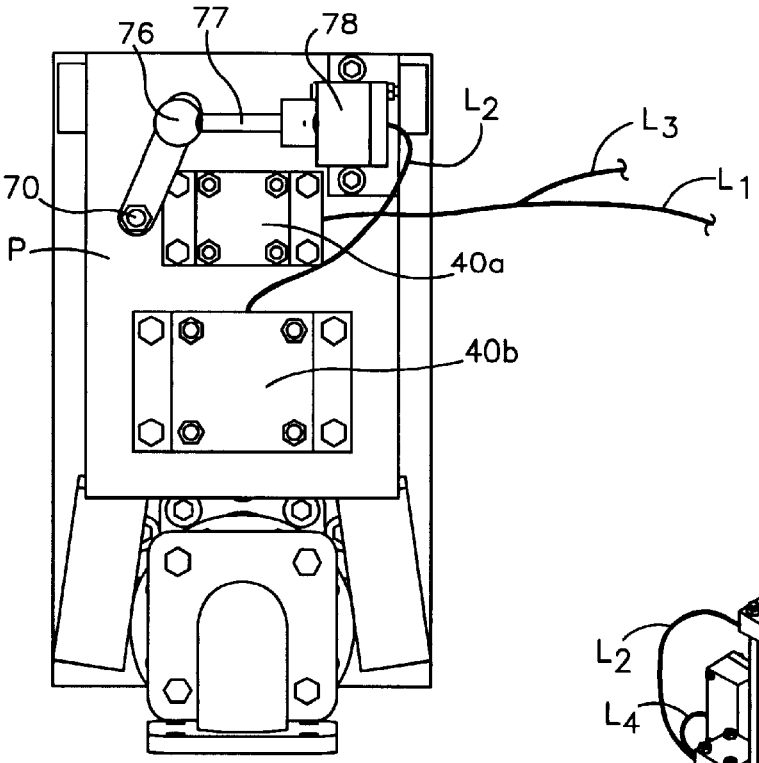
FIG. 3 is a top plan view of the pumping apparatus.
Figure 4:
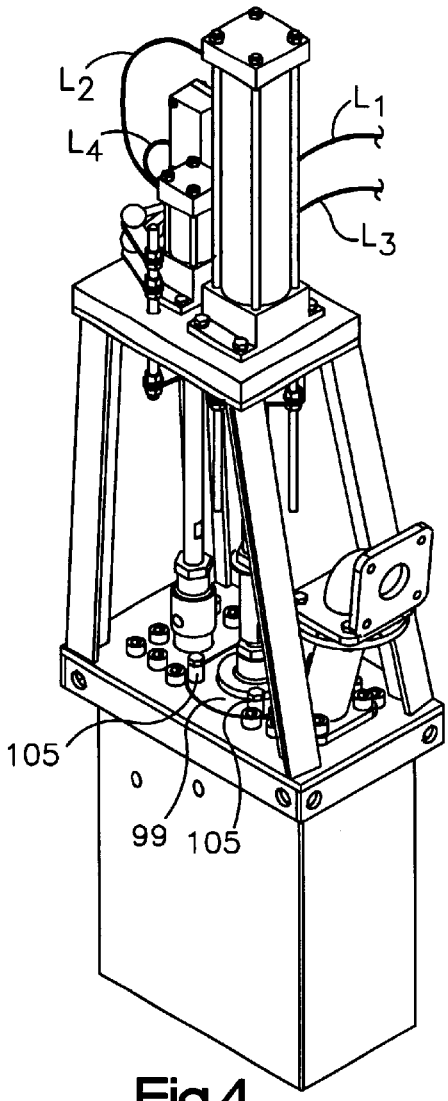
FIG. 4 is a perspective view of the pumping apparatus.
Figure 5:
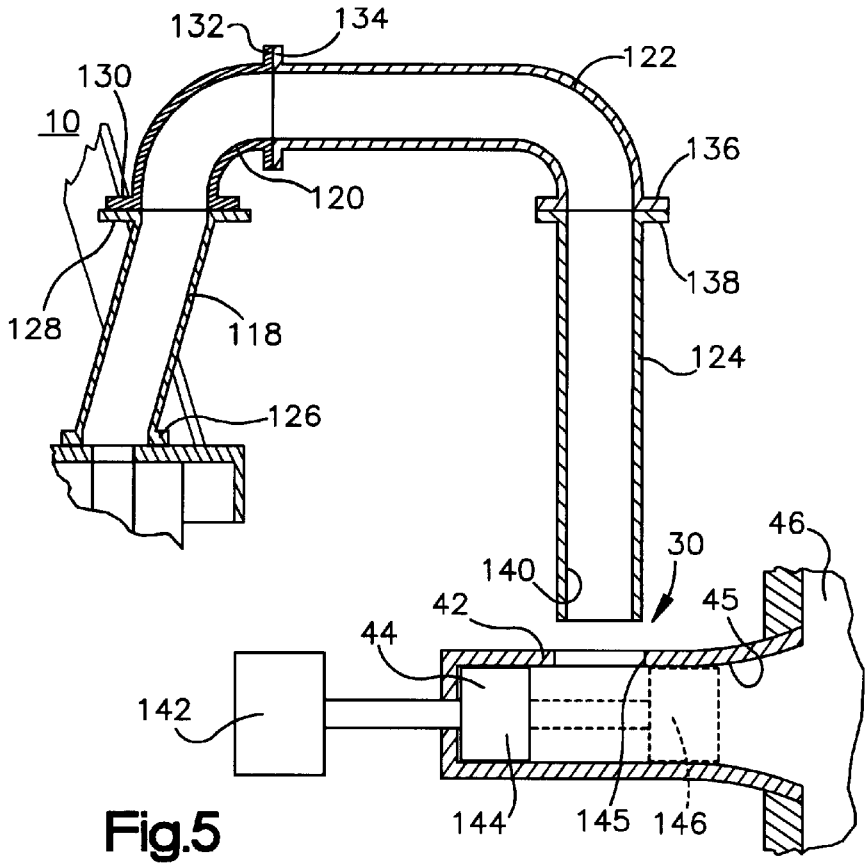
FIG. 5 is a cross-sectional view showing the shot sleeve and die.

The lantern is intended to prevent molten metal from passing above it. The design of the lantern enables molten metal in the pumping chamber to pass into through-openings 100 (only one of which is identified) between upper and lower sections 102, 104 of the lantern to an outer periphery 106 of the lantern and down to a relief opening 108 (FIG. 2). A drain opening 105 is also disposed in the valve chamber. The lantern is preferably comprised of graphite. The lantern construction is intended to enable the pressure in the pumping chamber to be minimal and possibly substantially zero above the lantern.

Figure 11:
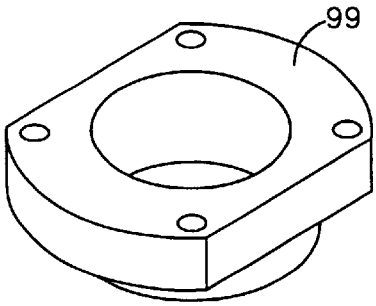
FIG. 11 is a member used for packing the seal assembly of FIG. 6.

A gland 99 (FIGS. 6 and 11) is disposed above the gasket assembly and is received in aligned openings in a lower (marinite) insulation board 101 and in an upper plate 103, which plates are fastened to the base. Fasteners 105 (FIG. 1) in the base are used to adjust the position of the gland against the gasket assembly. The fasteners are preferably flat wire compression springs ("smalley") made of carbon steel. The gland is movable in the outer diameter annular region R around the pumping chamber so as to ensure a tightly packed gasket assembly during use.

The pumping chamber is defined by a wall 109 (FIG. 6). The wall includes generally square grooves 110 formed therein. The grooves are used to inhibit molten metal from traveling upward along the plunger shaft.

A size of a gap 112 between the plunger and the pumping chamber wall (FIG. 6) is small enough that molten metal is inhibited from traveling upward, yet large enough to accommodate for differences in thermal expansion between the silicon carbide material of the plunger and the graphite material of the pump base as well as materials of the gaskets and square braid components. A size of a gap 114 (FIG. 1) between the valve and valve chamber is similarly selected to account for variations in thermal expansion.

The conduit 28 includes an exit passageway 116 (FIG. 1) which extends upwardly from the pumping chamber. This exit passageway 116 may be formed as a bore in the interior of the base block as shown or it may be a separate conduit that is attached to the base near the outlet opening 26 or in connection with the pumping chamber. The conduit also comprises, connected to the exit passageway 116, a pipe section 118, elbow 120, curved pipe section 122 and straight pipe section 124. The pipe section 118 includes upper and lower flanges 126, 128, the lower flange being fastened to the plate 103 and the upper flange being fastened to a lower flange 130 of the elbow. To an upper flange 132 of the elbow is fastened a flange 134 of the curved pipe section 122. To the other flange 136 of the curved section is fastened a flange 138 of the straight pipe section, which has an exit opening 140 at the discharge location 30 above the shot sleeve. The straight pipe section permits molten metal to be poured or injected into the shot sleeve.

The shot sleeve assembly and die are depicted schematically in the drawings. It will be understood that the shot sleeve and die may include various other components not shown or may include different structures. A ram is disposed in the shot sleeve so as to travel, upon actuation by a hydraulic cylinder mechanism 142, from an initial position 144 upstream of a shot sleeve opening 145 to an advanced position 146 downstream of the shot sleeve opening 145 and adjacent the die 46. Those skilled in the art would appreciate in view of this disclosure that suitable electronics and controllers may be used to fully automate the functioning of the valve piston, pumping piston, ram and die, in accordance with the present invention.

In operation, referring to FIGS. 1 and 12, the valve is lowered when an operator near the die moves a handle sending compressed air through line L1 to a location above the piston of the valve air cylinder. This causes the valve to move down and the upper kick plate to contact the ball handle. Once the valve is in its closed position, molten metal does not enter the valve chamber or pump chamber. The downward movement of the handle, in turn, causes compressed air to be sent via line L2 to a location above the piston of the air cylinder for the plunger, which in turn moves the plunger downward and forces molten metal under pressure through the exit opening of the pumping chamber and into the conduit. The molten metal travels through the exit passageway, the pipe section, the elbow, and the curved section, from which it is poured or injected through the straight pipe section and into the shot sleeve opening. When the die operator moves the handle in the other direction, compressed air is sent via line L3 below the piston of the valve air cylinder. This moves the valve up and moves the lower kick plate into contact with the handle, thereby moving the handle up. This upward movement of the handle causes compressed air to be sent below the piston of the air cylinder for the plunger via line L4, which causes the plunger to be moved up. The plunger is raised by an amount determined by the position and/or length of the positive stop member, to form the cavity 54 of a particular volume that corresponds to an amount of molten metal to be charged into the shot sleeve. The process is then repeated.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. An apparatus for pumping molten metal, comprising:

a pump base comprised of non-metallic, heat resistant material and adapted to be submerged in a bath of molten metal, said pump base comprising a molten metal inlet opening; a molten metal valve chamber in communication with said inlet opening; a molten metal pumping chamber; a passageway that communicates said valve chamber and said pumping chamber, and a molten metal outlet opening that communicates with said pumping chamber;

a first piston made of non-metallic, heat resistant material and adapted for reciprocal movement in said valve chamber;

a second piston made of non-metallic, heat resistant material and adapted for reciprocal movement in said pumping chamber;

at least one annular gasket comprised of refractory material disposed around said second piston in said pumping chamber;

a first connecting member that extends upwardly from said first piston;

a second connecting member that extends upwardly from said second piston; and at least one actuator in communication with said first member and said second member, wherein the at least one said actuator acts upon said first member and said second member to effect said reciprocal movement of said first piston and said second piston.

2. The apparatus of claim 1 comprising support structure connected to said base outside said bath.

3. The apparatus of claim 2 comprising at least one removable stop member disposed between said support structure and said second piston, the at least one said stop member having a length effective to restrict movement of said second piston by a distance corresponding to said length of said stop member.

4. The apparatus of claim 1 comprising an annular sealing member disposed around said second piston, said sealing member including radial outlet openings therethrough, said base including a drain opening in fluid communication with said outlet openings and extending to an exterior of said base.

5. The apparatus of claim 1 comprising a sealing wall having a larger diameter than said pumping chamber and an annular shoulder extending between said pumping chamber and said sealing wall, and a plurality of said gaskets disposed against said sealing wall around said second piston.

6. The apparatus of claim 5 further comprising a plurality of annular wire mesh members coated with refractory disposed against said sealing wall adjacent to one of said gaskets.

7. The apparatus of claim 6 further comprising a lantern member adjacent to one of said wire mesh members and said gaskets, wherein said lantern member comprises an annular upper face and an annular lower face and a plurality of openings extending from said pumping chamber to an outer periphery of said lantern.

8. The apparatus of claim 7 comprising a well having a wall which surrounds an upper end of said second piston and an annular gland member having an annular face adapted to contact one of said wire mesh members and said gaskets, said gland member comprising an outer periphery sized to fit within said well in engagement with the wall of said well.

9. The apparatus of claim 8 comprising at least one compression spring in contact with said gland adapted to adjust a vertical position of said gland against one of said wire mesh members and said gaskets.

10. The apparatus of claim 1 wherein said pumping chamber is defined by a wall including generally square grooves.

11. An apparatus for die casting molten metal, comprising:

a pump for pumping molten metal comprising:

(a) a pump base comprised of non-metallic, heat resistant material and adapted to be submerged in a bath of molten metal, said pump base comprising a molten metal inlet opening; a molten metal valve chamber in communication with said inlet opening; a molten metal pumping chamber; a passageway that communicates said valve chamber and said pumping chamber, and a molten metal outlet opening that communicates with said pumping chamber;

(b) a conduit extending from said outlet opening to a discharge location outside the bath, said conduit having an outlet located at said discharge location;

(c) a first piston made of non-metallic, heat resistant material and adapted for reciprocal movement in said valve chamber;

(d) a second piston made of non-metallic, heat resistant material and adapted for reciprocal movement in said pumping chamber;

(e) at least one annular gasket comprised of refractory material disposed around said second piston in said pumping chamber;

(f) a first connecting member that extends upwardly from said first piston;

(g) a second connecting member that extends upwardly from said second piston; and (h) at least one actuator in communication with said first member and said second member, wherein the at least one said actuator acts upon said first member and said second member to effect said reciprocal movement of said first piston and said second piston;

(i) a shot chamber fluidly connected with said discharge opening for receiving molten metal discharged from said conduit; and (j) a ram disposed in said chamber and adapted to direct molten metal in said chamber to a die for casting said molten metal.

12. The apparatus of claim 11 comprising support structure connected to said base outside said bath.

13. The apparatus of claim 12 comprising at least one removable stop member disposed between said support structure and said second piston, the at least one said stop member having a length effective to restrict upward movement of said second piston by a distance corresponding to said length of said stop member.

14. The apparatus of claim 11 comprising an annular sealing member disposed around said second piston, said sealing member including radial outlet openings therethrough, said base including a drain opening in fluid communication with said outlet openings and extending to an exterior of said base.

15. A method of pumping molten metal using a pump base that is comprised of non-metallic, heat resistant material and adapted to be submerged in a bath of molten metal, said pump base comprising a molten metal inlet opening, a valve chamber in communication with said inlet opening, a molten metal pumping chamber; a passageway that communicates said valve chamber and said pumping chamber, and a molten metal outlet opening that communicates with said pumping chamber, said method comprising:

a molten metal inlet stage comprising positioning a first piston made of non-metallic, heat resistant material at a location that enables molten metal to enter said valve chamber; and positioning a second piston made of non-metallic, heat resistant material in said pumping chamber so as to permit molten metal to enter said pumping chamber;

sealing said pumping chamber using an annular sealing member comprised of refractory material disposed around said second piston; and a molten metal pumping stage comprising positioning said first piston so as to prevent molten metal from entering said valve chamber;

moving said second piston so as to discharge molten metal from said pumping chamber and to direct molten metal through said outlet opening.

16. The method of claim 15 comprising restricting movement of said second piston by a predetermined distance so as to enable a metered amount of molten metal to be discharged from said pump base.

17. The method of claim 15 comprising relieving pressure by passing molten metal outwardly through radial exit openings in said sealing member and through a drain hole in said base to an exterior of said base.

18. The method of claim 15 wherein said second piston discharges the molten metal directly into a die.

19. A method of die casting molten metal using a pump base that is comprised of non-metallic, heat resistant material and adapted to be submerged in a bath of molten metal, said pump base comprising a molten metal inlet opening, a valve chamber in communication with said inlet opening, a molten metal pumping chamber; a passageway that communicates said valve chamber and said pumping chamber, and a molten metal outlet opening that communicates with said pumping chamber, said method comprising:

a molten metal feed stage comprising positioning a first piston made of non-metallic, heat resistant material at a location that enables molten metal to enter said valve chamber through said inlet opening, and positioning a second piston made of non-metallic, heat resistant material in said pumping chamber so as to permit molten metal to enter said pumping chamber;

sealing said pumping chamber using an annular sealing member comprised of refractory material disposed around said second piston;

a molten metal pumping stage comprising positioning said first piston so as to prevent molten metal from entering said valve chamber;

moving said second piston so as to discharge molten metal from said pumping chamber and to direct molten metal from said outlet opening through a conduit into a shot chamber located outside said bath; and injecting said molten metal in said shot chamber into a cavity of a die.

20. The method of claim 19 wherein said molten metal is exposed to external air before entering said shot chamber.

21. The method of claim 19 comprising passing molten metal to said shot chamber without exposing said molten metal to external air.

22. The method of claim 19 comprising sealing said pumping chamber using an annular sealing member disposed around said second piston, and relieving pressure by passing molten metal outwardly through radial exit openings in said sealing member and through a drain hole in said base to an exterior of said base.

23. In a method of die casting molten metal comprising moving a piston in a pumping chamber within a bath of molten metal to inject the molten metal into a die and then casting the molten metal, said improvement comprising sealing said pumping chamber using an annular sealing member disposed around said piston, and relieving pressure by passing molten metal outwardly through radial exit openings in said sealing member and through a drain hole in said base to an exterior of said base.

24. The method of claim 23 wherein said pumping chamber is further sealed using at least one annular gasket formed of refractory material around said piston.

* * * * *